United States Patent [19]

DeBoer

[11] Patent Number: 4,973,572

[45] Date of Patent: Nov. 27, 1990

[54] INFRARED ABSORBING CYANINE DYES FOR DYE-DONOR ELEMENT USED IN LASER-INDUCED THERMAL DYE TRANSFER

[75] Inventor: Charles D. DeBoer, Rochester, N.Y.

[73] Assignee: Eastman Kodak Company, Rochester, N.Y.

[21] Appl. No.: 463,095

[22] Filed: Jan. 10, 1990

Related U.S. Application Data

[63] Continuation-in-part of Ser. No. 363,836, Jun. 9, 1989, abandoned, which is a continuation-in-part of Ser. No. 221,163, Jul. 19, 1988, abandoned, which is a continuation-in-part of Ser. No. 136,074, Dec. 21, 1987, abandoned.

[51] Int. Cl.[5] ..... B41M 5/035; B41M 5/26

[52] U.S. Cl. ..... 503/227; 8/471; 428/195; 428/480; 428/913; 428/914; 430/200; 430/201; 430/945

[58] Field of Search ..... 8/471; 428/195, 480, 428/913, 914; 430/200, 201, 945; 503/227

[56] References Cited

FOREIGN PATENT DOCUMENTS

| | | | |
|---|---|---|---|
| 51-088016 | 12/1988 | Japan | 503/227 |
| 63-319191 | 12/1988 | Japan | 503/227 |
| 2083726 | 3/1982 | United Kingdom | 503/227 |

*Primary Examiner*—Bruce H. Hess
*Attorney, Agent, or Firm*—Harold E. Cole

[57] ABSTRACT

A dye-donor element for laser-induced thermal dye transfer comprising a support having thereon a dye layer comprising a polymeric binder and an infrared-absorbing material which is different from the dye in the dye layer, and wherein the infrared-absorbing material is a cyanine dye having a solution absorption maximum in methanol of between about 700 nm and 900 nm and having the following formula:

or wherein:

$R^1$ and $R^2$ each independently represents a substituted or unsubstituted alkyl group;

$R^3$, $R^4$, $R^5$, $R^6$, $R^7$, and $R^8$ each independently represents hydrogen or a substituted or unsubstituted alkyl group;

or any two of said $R^1$, $R^2$, $R^3$, $R^4$, $R^5$, $R^6$, $R^7$ and $R^8$ groups may be joined together, directly or through one or more methyne or methylene groups to complete a substituted or unsubstituted carbocyclic or heterocyclic ring of 5 to 9 members;

$Z^1$ and $Z^2$ each independently represents hydrogen or the atoms necessary to complete a unsubstituted or substituted benzene or naphthalene ring;

$Y^1$ represents a dialkyl-substituted carbon atom, a vinylene group, an oxygen atom, a sulphur atom, a selenium atom, a nitrogen atom with an $R^1$ or a substituted or unsubstituted aryl group attached, or direct bond between the B-ring vinylene carbon and the carbon at the $R^4$ position;

$Y^2$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the B-ring vinylene carbon and the carbon at the $R^7$ position;

J represents hydrogen; a substituted or unsubstituted alkyl group; a substituted or unsubstituted aryl group; a halogen atom; or a nitrogen atom substituted with an alkyl or aryl group, or the atoms necessary to complete a 5- or 6-membered heterocyclic ring;

n and m each independently represents 0, 1 or 2; and

X is a monovalent anion.

19 Claims, No Drawings

INFRARED ABSORBING CYANINE DYES FOR DYE-DONOR ELEMENT USED IN LASER-INDUCED THERMAL DYE TRANSFER

This application is a continuation-in-part of U.S. application Ser. No. 363,836, filed June 9, 1989, now abandoned, which is a continuation-in-part of U.S. application Ser. No. 221,163, filed July 19, 1988, now abandoned, which is a continuation-in-part of U.S. application Ser. No. 136,074, filed Dec. 21, 1987, now abandoned.

This invention relates to dye-donor elements used in laser induced thermal dye transfer, and more particularly to the use of certain infrared absorbing cyanine dyes.

In recent years, thermal transfer systems have been developed to obtain prints from pictures which have been generated electronically from a color video camera. According to one way of obtaining such prints, an electronic picture is first subjected to color separation by color filters. The respective color separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB No. 2,083,726A, the disclosure of which is hereby incorporated by reference.

In GB No. 2,083,726A, the absorbing material which is disclosed for use in their laser system is carbon. There is a problem with using carbon as the absorbing material in that it is particulate and has a tendency to clump when coated which may degrade the transferred dye image. Also, carbon may transfer to the receiver by sticking or ablation causing a mottled or desaturated color image. It would be desirable to find an absorbing material which did not have these disadvantages.

Japanese Kokai No. 63/319,191 relates to a transfer material for heat sensitive recording comprising a layer containing a substance which generates heat upon irradiation by a laser beam and another layer containing a subliming dye on a support. Compounds 4–10 of that reference which generate heat upon irradiation are similar to the cyanine dyes described herein. However, the materials in the reference are specifically described as being located in a separate layer from the dye layer.

There is a problem with having the infrared absorbing material in a separate layer from the dye layer in that the transfer efficiency is not as good as it should be. It would be desirable to provide a class of cyanine dyes useful with a dye-donor element which has a greater transfer efficiency, i.e., more density per unit of laser input energy, than those of the prior art.

Japanese Kokai No. 51/88,016 relates to a recording material for heat sensitive recording containing an absorbing agent which absorbs the light energy. Compounds 16, 17, and the ones employed in examples 3 and 4 of that reference which generate heat upon irradiation are similar to the cyanine dyes described herein. However, the cyanine dyes of the reference have a solution absorption maximum outside the range for the cyanine dyes claimed herein, e.g., the compound from example 4 was measured as 652 nm in methanol, the compound from example 3 was measured as 446 nm in methanol and compound 17 was measured as 950 nm in methanol.

There is a problem with having the infrared absorbing material absorb outside the range claimed herein in that they are less efficient, i.e., would provide less density for a given unit of laser input energy than the dyes of the invention, when used with readily-available lasers which emit between 700 nm and 900 nm, such as diode lasers, e.g., gallium arsenide lasers. It would be desirable to provide a class of cyanine dyes useful with a dye-donor element which has a greater transfer efficiency, i.e., more density per unit of laser input energy, than those of the prior art.

These and other objects are achieved in accordance with this invention which relates to a dye-donor element for laser induced thermal dye transfer comprising a support having thereon a dye layer comprising a polymeric binder and an infrared absorbing material which is different from the dye in the dye layer, and wherein the infrared absorbing material is a cyanine dye having a solution absorption maximum in methanol of between about 700 nm and 900 nm and having the following formula:

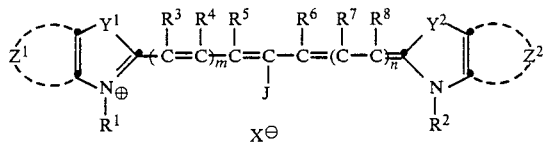

or

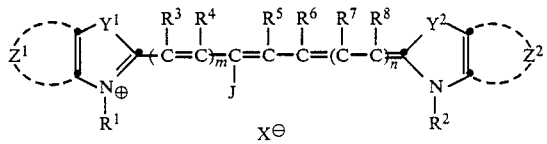

wherein:

$R^1$ and $R^2$ each independently represents a substituted or unsubstituted alkyl group such as $—CH_3$, $—C_2H_5$, $—(CH_2)_2—OCH_3$, $—(CH_2)_3CO_2CH_3$, $—C_3H_7$, $—C_4H_9$, or $—(CH_2)_3Cl$; $R^3$, $R^4$, $R^5$, $R^6$, $R^7$, and $R^8$ each independently represents hydrogen or a substituted or unsubstituted alkyl group, such as those mentioned above for $R^1$ and $R^2$; or any two of said $R^1$, $R^2$, $R^3$, $R^4$, $R^5$, $R^6$, $R^7$ or $R^8$ groups may be joined together, directly or through one or more methyne or methylene groups to complete a substituted or unsubstituted carbocyclic or heterocyclic ring of 5 to 9 members, such as

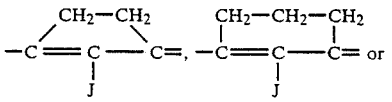

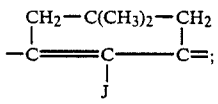

$Z^1$ and $Z^2$ each independently represents hydrogen or the atoms necessary to complete a unsubstituted or substituted benzene or naphthalene ring;

$Y^1$ represents a dialkyl substituted carbon atom, such as $—C(CH_3)_2—$ or $—C(C_2H_5)_2—$; a vinylene group, an oxygen atom, a sulphur atom, a selenium atom, a nitrogen atom with an $R^1$ or a substituted or unsubstituted aryl group attached or a direct bond between the B-ring vinylene carbon and the carbon at the $R^4$ position;

$Y^2$ represents a dialkyl substituted carbon atom, a vinylene group, an oxygen atom, a sulphur atom, a selenium atom, a nitrogen atom with an $R^1$ or a substituted or unsubstituted aryl group attached, or a direct bond to the carbon at the $R^7$ position;

J represents hydrogen; a substituted or unsubstituted alkyl group such as those mentioned above for $R^1$ and $R^2$; a substituted or unsubstituted aryl group;

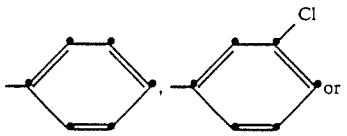

-continued

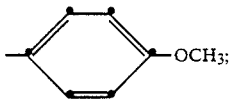

a halogen atom; or a nitrogen atom substituted with an alkyl or aryl group, or the atoms necessary to complete a 5- or 6-membered heterocyclic ring, such as

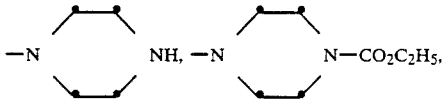

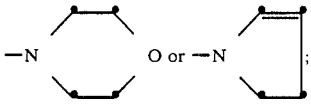

n and m each independently represents 0, 1 or 2; and

X is a monovalent anion such as $I^{\ominus}$, $BF_4^{\ominus}$, $ClO_4^{\ominus}$, $PF_6^{\ominus}$ or $Br^{\ominus}$.

In a preferred embodiment of the invention both $R^1$ and $R^2$ are methyl and J is halogen. In another preferred embodiment, $R^5$ and $R^6$ are joined together to complete a 6-membered carbocyclic ring. In still another preferred embodiment, $Z^1$ and $Z^2$ both represent the atoms necessary to complete a benzene ring substituted with a nitro, halo or cyano group. In another preferred embodiment, $Z^1$ and $Z^2$ each represents the atoms necessary to complete a naphthalene ring. In still yet another preferred embodiment, both $Y^1$ and $Y^2$ represent a dialkyl substituted carbon atom.

The above infrared absorbing dyes may employed in any concentration which is effective for the intended purpose. In general, good results have been obtained at a concentration from about 0.04 to about 0.5 $g/m^2$ within the dye layer itself or in an adjacent layer.

Spacer beads may be employed in a separate layer over the dye layer in order to separate the dye-donor from the dye-receiver thereby increasing the uniformity and density of dye transfer. That invention is more fully described in U.S. Pat. No. 4,772,582. The spacer beads may be coated with a polymeric binder if desired.

Dyes included within the scope of the invention include the following:

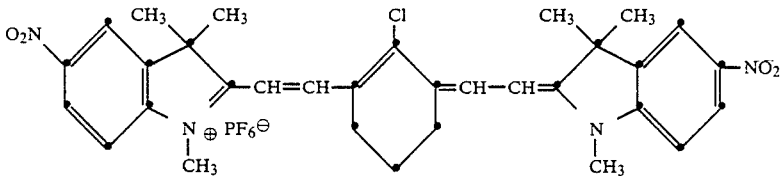

Compound 1

λmax = 789 nm in methanol

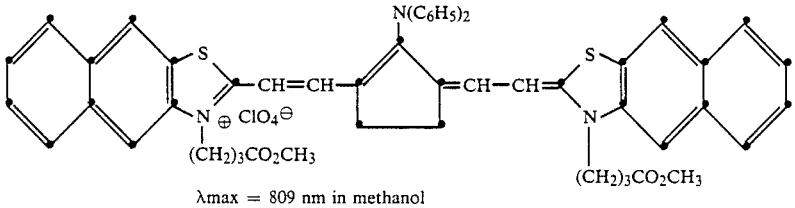

Compound 2

λmax = 809 nm in methanol

-continued
Compound 3
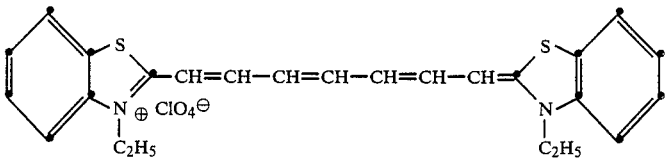
λmax = 765 nm in methanol
Compound 4
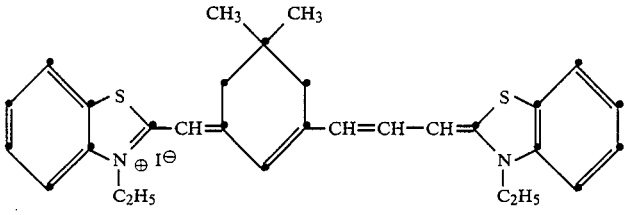
λmax = 765 nm in methanol
Compound 5
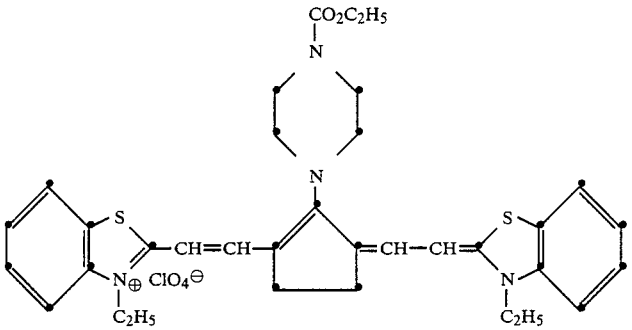
λmax = 731 nm in methanol
Compound 6
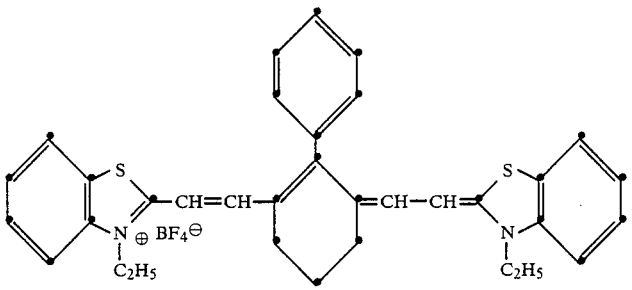
λmax = 779 nm in methanol
Compound 7
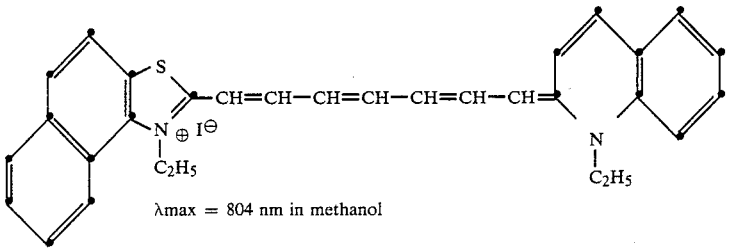
λmax = 804 nm in methanol -continued
Compound 8
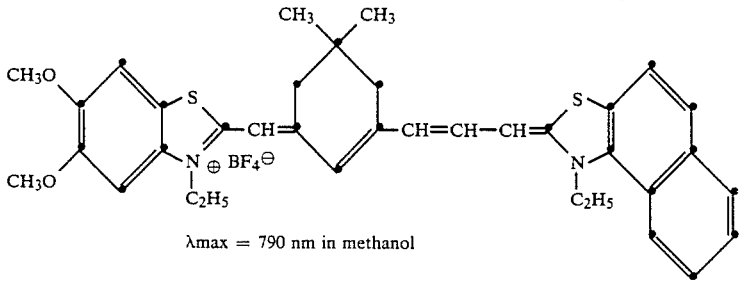
λmax = 790 nm in methanol
Compound 9
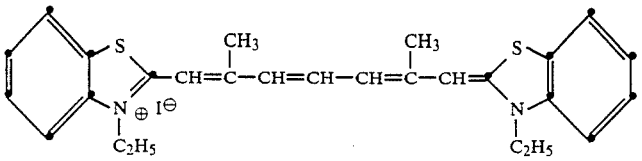
λmax = 775 nm in methanol
Compound 10
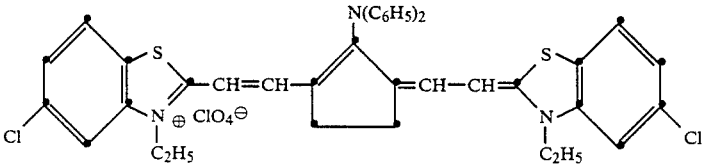
λmax = 802 nm in methanol
Compound 11
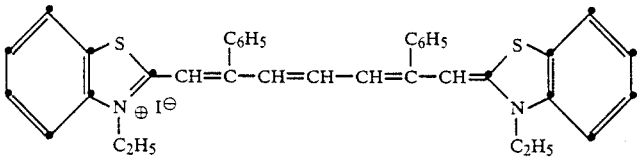
λmax = 780 nm in methanol
Compound 12
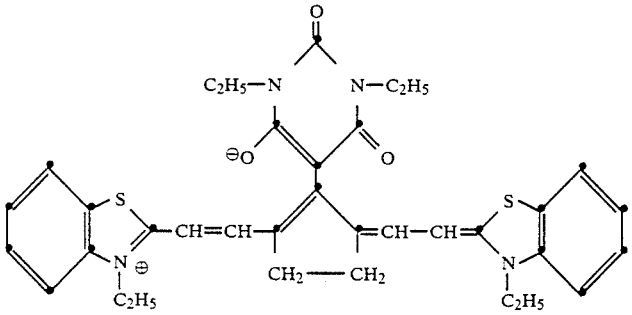
λmax = 809 nm in methanol
Compound 13
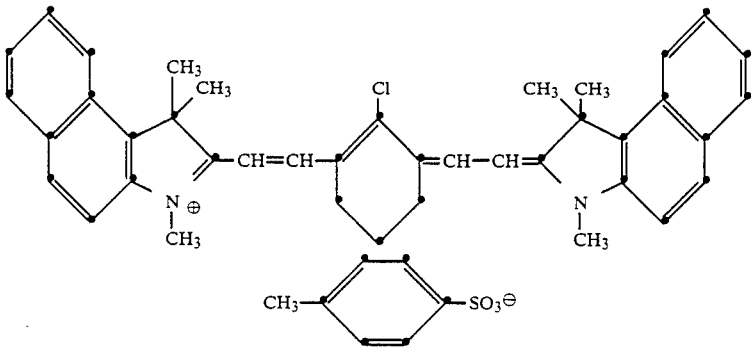
λmax = 812 nm in methanol -continued
Compound 14
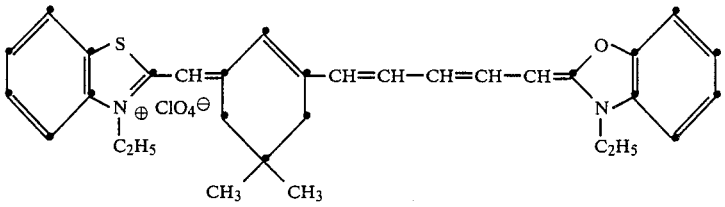
Compound 15
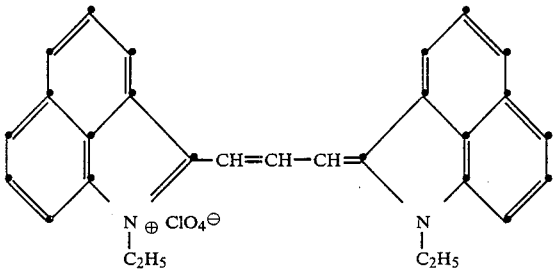
Compound 16
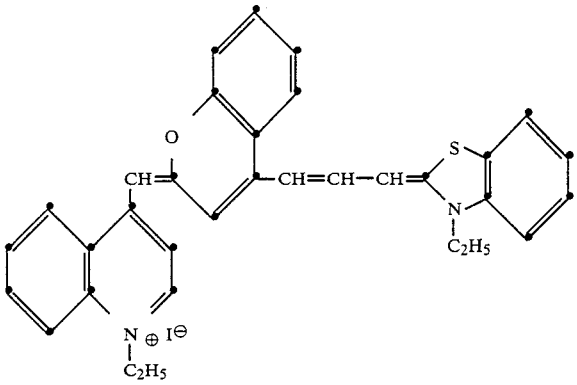
Compound 17
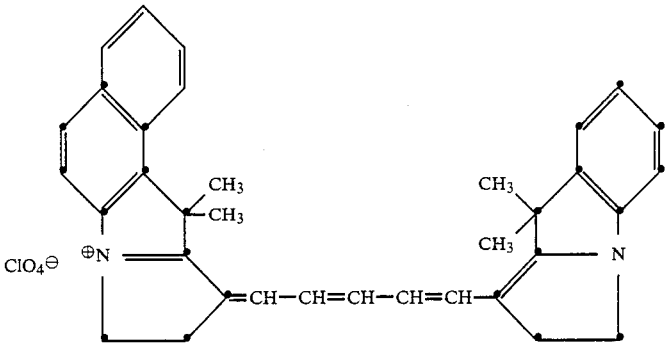
Compound 18
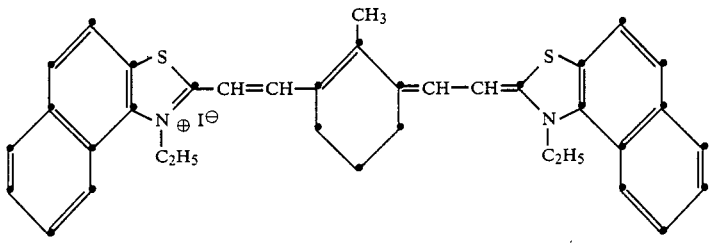

-continued
Compound 19
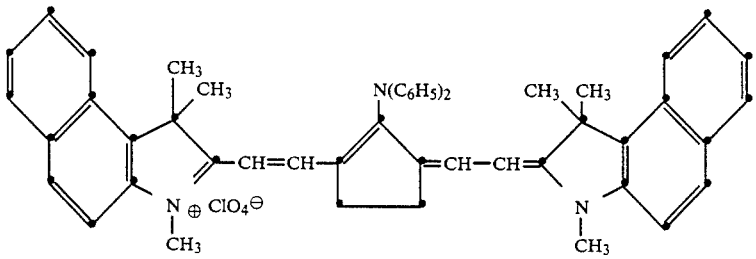
Compound 20
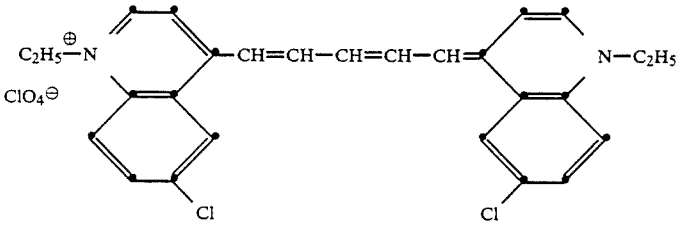
Compound 21
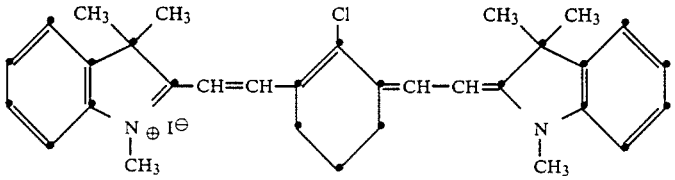
Compound 22
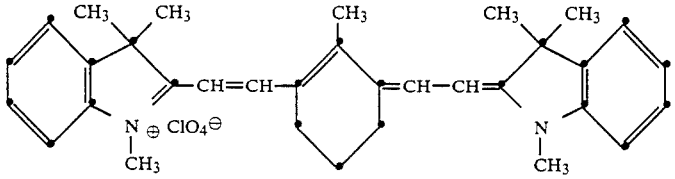
Compound 23
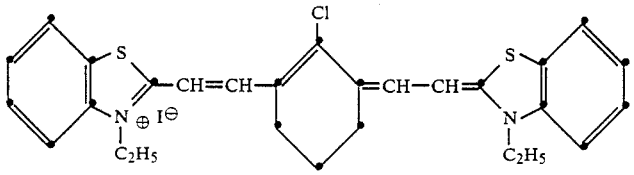
λmax = 810 nm in methanol
Compound 24
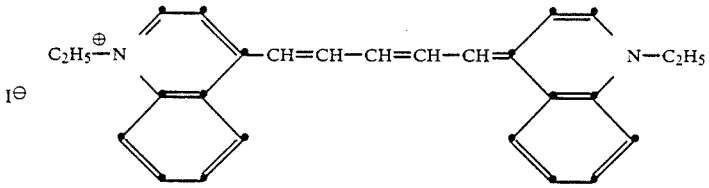
λmax = 812 nm in methanol
Compound 25
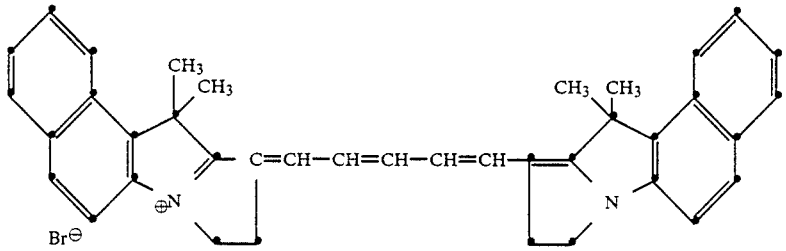
λmax = 814 nm in methanol -continued Compound 26

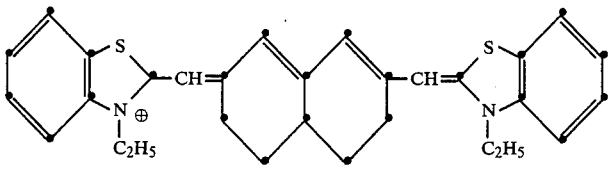

λmax = 742 nm in methanol

Compound 27

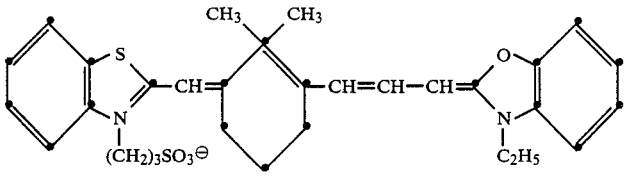

λmax = 728 nm in methanol

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R FS ® (Mitsubishi Chemical Industries, Ltd.), and Kayalon Polyol Brilliant Blue N-BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd ), and Aizen Malachite Green ® (Hodogaya Chemical Co., Ltd.);

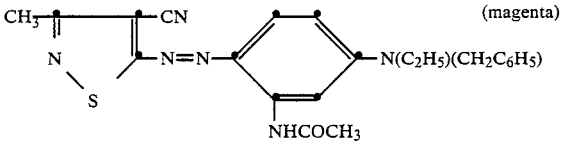

(magenta)

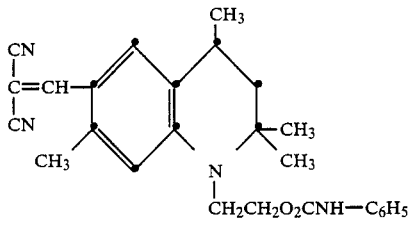

(yellow)

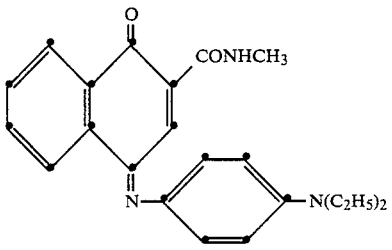

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate., poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat generated by the laser beam. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers. The support generally has a thickness of from about 2 to about 250 μm. It may also be coated with a subbing layer, if desired.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta coated paper, polyethylene coated paper, white polyester (polyester with white pigment incorporated therein), an ivory paper, a condenser paper or a synthetic paper such as duPont Tyvek ®.

The dye image receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above using a laser, and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Several different kinds of lasers could conceivably be used to effect the thermal transfer of dye from a donor sheet to a receiver, such as diode lasers, e.g. gallium arsenide emitting in the infrared region from 750 to 870 nm. The diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Lasers which can be used to transfer dye from the dye-donor elements of the invention are available commercially. There can be employed, for example, Laser Model SDL-2420-H2 ® from Spectrodiode Labs, or Laser Model SLD 304 V/W ® from Sony Corp.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is adjacent to and overlying the image receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied using the laser beam. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1—Magenta Dye-Donor

A dye-donor element according to the invention was prepared by coating an unsubbed 100 μm thick poly(ethylene terephthalate) support with a layer of the magenta dye illustrated above (0.38 g/m$^2$), infrared absorbing dye Compound 1 (0.14 g/m$^2$) in a cellulose acetate propionate binder (2.5% acetyl, 45% propionyl) (0.27 g/m$^2$) coated from a cyclohexanone and butanone solvent mixture.

Over the dye layer was coated an overcoat of polystyrene beads (av. diameter 8 μm) (0.02 g/m$^2$) from an aqueous solution as described in U.S. Pat. No. 4,772,582 discussed above.

A control dye-donor element was made as above but omitting the magenta imaging dye.

A second control dye-donor element was as described above on a 75 μm thick ly(ethylene terephthalate) support subbed with gelatin, but containing 0.32 g/m$^2$ of the following control dye (a non-infrared absorbing cyanine dye).

Control Dye:

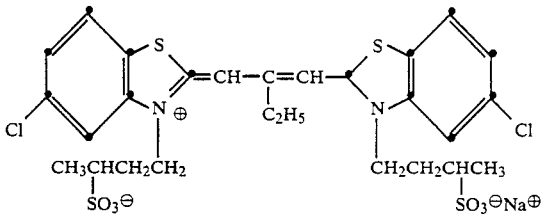

A third control dye-donor element was prepared similar to the second control element, but the concentration of the magenta dye was increased to 0.45 g/m$^2$, the infrared absorbing dye was replaced with dispersed carbon (0.60 g/m$^2$), and the cellulose acetate propionate binder (0.50 g/m$^2$) was coated from a toluene and tetrahydrofuran solvent mixture.

A dye-receiving element was prepared by coating a solution of Makrolon 5705 ® a bisphenol A-polycarbonate resin supplied by Bayer AG (4.0 g/m$^2$) in a methylene chloride-trichloroethylene solvent mixture on a 175 μm poly(ethyleneterephthalate) support containing titanium dioxide.

The dye-receiver was overlaid with the dye-donor placed on a drum and taped with just sufficient tension to be able to see the deformation of the surface beads. The assembly was then exposed on a 180 rpm rotating drum to a focused 830 nm laser beam from a Spectrodiode Labs Laser Model SDL-2420-H2 ® using a 50 μm spot diameter and an exposure time of 0.5 millisec. to transfer the areas of dye to the receiver. The power level was 86 milliwatts and the exposure energy was 44 microwatts/square micron.

The following observations of the image produced on each receiver were made:

The dye-donor element containing Compound 1 produced a defined magenta image in the receiver with no visible color contamination from the cyanine dye. The Status A green reflection density was 2.3.

The first control dye-donor element containing only the cyanine dye but no magenta image dye did not have any visible image in the receiver.

The second control dye-donor element also did not have any visible image, which was probably due to the fact that this dye does not absorb appreciably at 830 nm, having a λ-max of 600 nm.

The third control dye-donor element containing carbon as the absorbing material produced an image but the Status A reflection density was only 1.2 The image had a mottled appearance probably due to the clumping of the carbon dispersion during the drying process. Small specks of carbon were also observed to transfer to the receiver.

EXAMPLE 2—Cyan Dye-Donor

A dye-donor element according to the was prepared by coating an unsubbed 100 μm thick poly(ethylene terephthalate) support with a layer of the cyan dye illustrated above (0.40 g/m$^2$), infrared absorbing dye Compound 2 (0.14 g/m$^2$) in a cellulose acetate propionate binder (2.5% acetyl, 45% propionyl) (0.20 g/m$^2$) coated from a cyclohexanone and butanone solvent mixture.

Over the dye layer was coated an overcoat of polystyrene beads (av. diameter 8 μm) (0.02 g/m$^2$) from an aqueous solution as in Example 1.

A control dye-donor element was made as above but omitted the infrared absorbing dye A dye-receiving element was prepared and processed as in Example 1.

The following observations of the image produced on each receiver were made:

The dye-donor element containing Compound 2 produced a uniform cyan image in the receiver having a density of 0.7.

The control dye-donor element did not have any visible image in the receiver.

EXAMPLE 3—Cyan Dye-Donors—Positive Imaging

Dye-donors according to the invention were prepared by coating on an unsubbed 100 μm thick polyethylene terephthalate support a layer of the cyan dye illustrated above (0.38 g/m$^2$), infrared absorbing dye Compounds 1, 3, 5 and 10 (0.13 g/m$^2$), and CIBA-Geigy Tinuvin 770 ® hindered amine stabilizer (0.26 g/m$^2$) in a cellulose nitrate binder (0.89 g/m$^2$) coated from a dimethylformamide and butanone solvent mixture.

Over the dye layer was coated an overcoat of polystyrene beads (av. diameter 8 μm) (0.22 g/m$^2$) as described in Example 1.

A control donor coating was made as above but omitted the cyanine infrared absorbing dye.

A dye-receiver was prepared and processed as in Example 1 except that the drum rotation was 120 rpm.

The Status A red reflection density of the receivers were read. As shown in Table 1, except for the control which had a density of 0.2, dye-donors with added cyanine dye produced densities of 0.5 or more.

In a second variation to demonstrate positive imaging, the Status A red transmission density of the dye-donors were first read. The evaluation was done as above but no dye-receiver was used; instead an air stream was blown over the donor surface to remove sublimed dye. The Status A red density of the original dye-donor was compared to the residual density after the cyan image dye was sublimed away by the laser. All the densities were reduced to 1.0 or below where the cyanine dye of the invention was present, thus showing their effectiveness in positive imaging.

TABLE 1

| Infrared Dye in Donor | Status A Red Density | | |
|---|---|---|---|
| | Donor-Initial | Donor-Residual | Receiver-Transferred |
| None (control) | 3.2 | 1.9 | 0.2 |
| Compound 1 | 3.0 | 0.3 | 0.8 |
| Compound 3 | 3.5 | 1.0 | 1.0 |
| Compound 5 | 1.9 | 0.6 | 1.2 |
| Compound 10 | 3.2 | 0.8 | 0.5 |

EXAMPLE 4—Magenta Dye-Donors

Dye-donors were prepared as in Example 3 but used the magenta dye illustrated above (0.38 g/m$^2$), omitted the stabilizer and used compounds 9, 11 and 12.

A control donor coating was made as above, but omitted the cyanine infrared absorbing dye.

A dye-receiver was prepared and processed as in Example 1 and the receiver was read to Status A green reflection density as follows:

TABLE 2

| Infrared Dye in Donor | Status A Green Density Transferred to Receiver |
|---|---|
| None (control) | 0.0 |
| Compound 9 | 0.1 |
| Compound 11 | 0.6 |
| Compound 12 | 0.4 |

The above results indicate that all the coatings containing an infrared absorbing cyanine dye gave substantially more density than the control.

EXAMPLE 5—Magenta Dye-Donor

A dye-donor element according to the invention was prepared by coating an unsubbed 100 μm thick poly(ethylene terephthalate) support with a layer of the magenta dye illustrated above (0.38 g/m$^2$), the infrared absorbing dye indicated in Table 3 below (0.14 g/m$^2$) in a cellulose acetate propionate binder (2.5% acetyl, 45% propionyl) (0.27 g/m$^2$) coated from methylene chloride.

A control dye-donor element was made as above containing only the magenta imaging dye.

A second control dye-donor element was prepared as described above but containing 0.14 g/m$^2$ of the control dye of Example 1.

A commercial clay-coated matte finish lithographic printing paper (80 pound Mountie-Matte from the Seneca Paper Company) was used as the dye-receiving element.

The dye-receiver was overlaid with the dye-donor placed on a drum with a circumference of 295 mm and taped with just sufficient tension to be able to see the deformation of the surface of the dye-donor by reflected light. The assembly was then exposed with the drum rotating at 180 rpm to a focused 830 nm laser beam from a Spectra Diode Labs laser model SDL-2430-H2 using a 33 micrometer spot diameter and an exposure time of 37 microseconds. The spacing between lines was 20 micrometers, giving an overlap from line to line of 39%. The total area of dye transfer to the receiver was 6×6 mm. The power level of the laser was approximately 180 milliwatts and the exposure energy, including overlap, was 10 ergs per square micron.

The Status A green reflection density of each transferred dye area was read as follows:

TABLE 3

| Infrared Dye in Donor | Status A Green Density Transferred to Receiver |
|---|---|
| None (control) | 0.0 |
| Control | 0.0 |
| Compound 2 | 1.2 |
| Compound 13 | 1.1 |
| Compound 23 | 1.1 |
| Compound 24 | 1.2 |
| Compound 25 | 1.2 |
| Compound 26 | 1.2 |
| Compound 27 | 1.1 |

The above results indicate that all the coatings containing an infrared absorbing cyanine dye according to the invention gave substantially more density than the controls.

The invention has been described in detail with particular reference to preferred embodiments thereof, but it will be understood that variations and modifications can be effected within the spirit and scope of the invention.

What is claimed is:

1. In a dye-donor element for laser-induced thermal dye transfer comprising a support having thereon a dye layer comprising a polymeric binder and an infrared-absorbing material which is different from the dye in said dye layer, the improvement wherein said infrared-absorbing material is a cyanine dye having a solution absorption maximum in methanol of between about 700 nm and 900 nm and having the following formula:

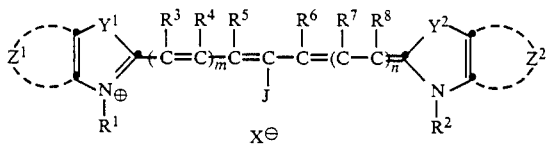

or

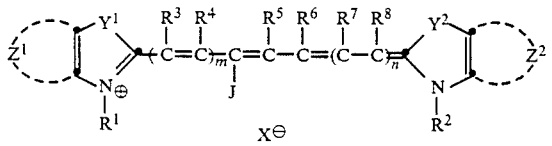

wherein:

$R^1$ and $R^2$ each independently represents a substituted or unsubstituted alkyl group;

$R^3$, $R^4$, $R^5$, $R^6$, $R^7$, and $R^8$ each independently represents hydrogen or a substituted or unsubstituted alkyl group;

or any two of said $R^1$, $R^2$, $R^3$, $R^4$, $R^5$, $R^6$, $R^7$ or $R^8$ groups may be joined together, directly or through one or more methyne or methylene groups to complete a substituted or unsubstituted carbocyclic or heterocyclic ring of 5 to 9 members;

$Z^1$ and $Z^2$ each independently represents hydrogen or the atoms necessary to complete a unsubstituted or substituted benzene or naphthalene ring;

$Y^1$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the $\beta$-ring vinylene carbon and the carbon at the $R^4$ position;

$Y^2$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the $\beta$-ring vinylene carbon and the carbon at the $R^7$ position;

J represents hydrogen; a substituted or unsubstituted alkyl group; a substituted or unsubstituted aryl group; a halogen atom; or a nitrogen atom substituted with an alkyl or aryl group, or the atoms necessary to complete a 5- or 6-membered heterocyclic ring;

n and m each independently represents 0, 1 or 2; and

X is a monovalent anion.

2. The element of claim 1 wherein both $R^1$ and $R^2$ are methyl and J is halogen.

3. The element of claim 1 wherein $R^5$ and $R^6$ are joined together to complete a 6-membered carbocyclic ring.

4. The element of claim 1 wherein $Z^1$ and $Z^2$ both represent the atoms necessary to complete a benzene ring substituted with nitro, halo or cyano group.

5. The element of claim 1 wherein $Z^1$ and $Z^2$ each represents the atoms necessary to complete a naphthalene ring.

6. The element of claim 1 wherein both $Y^1$ and $Y^2$ represent a dialkyl-substituted carbon atom.

7. The element of claim 6 wherein said dye layer comprises sequential repeating areas of cyan, magenta and yellow dye.

8. In a process of forming a laser-induced thermal dye transfer image comprising (a) imagewise-heating by means of a laser a dye-donor element comprising a support having thereon a dye layer comprising a polymeric binder and an infrared-absorbing material which is different from the dye in said dye layer, and (b) transferring a dye image to a dye-receiving element to form said laser-induced thermal dye transfer image, the improvement wherein said infrared-absorbing material is a cyanine dye having a solution absorption maximum in methanol of between about 700 nm and 900 nm and having the following formula:

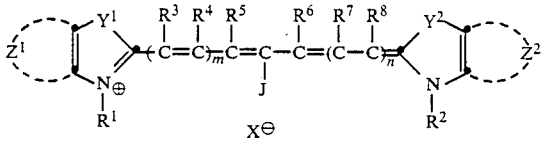

or

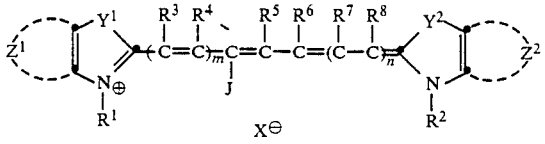

wherein:

$R^1$ and $R^2$ each independently represents a substituted or unsubstituted alkyl group;

$R^3$, $R^4$, $R^5$, $R^6$, $R^7$, and $R^8$ each independently represents hydrogen or a substituted or unsubstituted alkyl group;

or any two of said $R^1$, $R^2$, $R^3$, $R^4$, $R^5$, $R^6$, $R^7$ or $R^8$ groups may be joined together, directly or through one or more methyne or methylene groups to complete a substituted or unsubstituted carbocyclic or heterocyclic ring of 5 to 9 members;

$Z^1$ and $Z^2$ each independently represents hydrogen or the atoms necessary to complete a unsubstituted or substituted benzene or naphthalene ring;

$Y^1$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the $\beta$-ring vinylene carbon and the carbon at the $R^4$ position;

$Y^2$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the $\beta$-ring vinylene carbon and the carbon at the $R^7$ position;

J represents hydrogen; a substituted or unsubstituted alkyl group; a substituted or unsubstituted aryl group; a halogen atom; or a nitrogen atom substituted with an alkyl or aryl group, or the atoms necessary to complete a 5- or 6-membered heterocyclic ring;

n and m each independently represents 0, 1 or 2; and X is a monovalent anion.

9. The process of claim 8 wherein both $R^1$ and $R^2$ are methyl and J is halogen.

10. The process of claim 8 wherein $R^3$ and $R^4$ are joined together to complete a 6-membered cyclic ring.

11. The process of claim 8 wherein $Z^1$ and $Z^2$ both represent the atoms necessary to complete a benzene ring substituted with nitro, halo or cyano group.

12. The process of claim 8 wherein both $Y^1$ and $Y^2$ represent a dialkyl-substituted carbon atom.

13. The process of claim 8 wherein said support is poly(ethylene terephthalate) which is coated with sequential repeating areas of cyan, magenta and yellow dye, and said process steps are sequentially performed for each color to obtain a three-color dye transfer image.

14. In a thermal dye transfer assemblage comprising:

(a) a dye-donor element comprising a support having a dye layer comprising a polymeric binder and an infrared absorbing material which is different from the dye in said dye layer, and (b) a dye-receiving element comprising a support having thereon a dye image-receiving layer, said dye-receiving element being in a superposed relationship with said dye-donor element so that said dye layer is adjacent to said dye image-receiving layer, the improvement wherein said infrared-absorbing material is a cyanine dye having a solution absorption maximum in methanol of between about 700 nm and 900 nm and having the following formula:

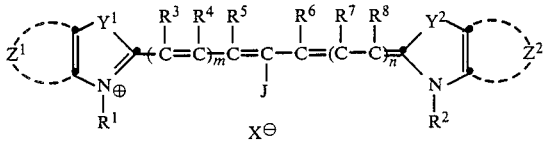

or

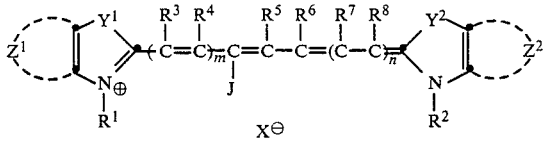

wherein:

$R^1$ and $R^2$ each independently represents a substituted or unsubstituted alkyl group;

$R^3$, $R^4$, $R^5$, $R^6$, $R^7$, and $R^8$ each independently represents hydrogen or a substituted or unsubstituted alkyl group;

or any two of said $R^1$, $R^2$, $R^3$, $R^4$, $R^5$, $R^6$, $R^7$ or $R^8$ groups may be joined together, directly or through one or more methyne or methylene groups to complete a substituted or unsubstituted carbocyclic or heterocyclic ring of 5 to 9 members;

$Z^1$ and $Z^2$ each independently represents hydrogen or the atoms necessary to complete a unsubstituted or substituted benzene or naphthalene ring;

$Y^1$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the $\beta$-ring vinylene carbon and the carbon at the $R^4$ position;

$Y^2$ represents a dialkyl-substituted carbon atom, a vinylene group, an oxygen atom, a sulphur atom, a selenium atom, a nitrogen atom with an $R^1$ or a substituted or unsubstituted aryl group attached, or a direct bond between the $\beta$-ring vinylene carbon and the carbon at the $R^7$ position;

J represents hydrogen; a substituted or unsubstituted alkyl group; a substituted or unsubstituted aryl group; a halogen atom; or a nitrogen atom substituted with an alkyl or aryl group, or the atoms necessary to complete a 5- or 6-membered heterocyclic ring;

n and m each independently represents 0, 1 or 2; and X is a monovalent anion.

15. The assemblage of claim 14 wherein both $R^1$ and $R^2$ are methyl and J is halogen.

16. The assemblage of claim 14 wherein $R^3$ and $R^4$ are joined together to complete a 6-membered cyclic ring.

17. The assemblage of claim 14 wherein $Z^1$ and $Z^2$ both represent the atoms necessary to complete a benzene ring substituted with nitro, halo or cyano group.

18. The assemblage of claim 14 wherein both $Y^1$ and $Y^2$ represent a dialkyl-substituted carbon atom.

19. The assemblage of claim 14 wherein said support of the dye-donor element comprises poly(ethylene terephthalate) and said dye layer comprises sequential repeating areas of cyan, magenta and yellow dye.

* * * * *